United States Patent [19]

Frantl

[11] Patent Number: 4,953,329

[45] Date of Patent: Sep. 4, 1990

[54] SINGLE-LAYER, POLYGONALLY-CURVED SUPPORTING FRAME STRUCTURE

[76] Inventor: Erich Frantl, Laudongasse 33/76, A-1080 Wien, Austria

[21] Appl. No.: 215,490

[22] Filed: Jul. 6, 1988

[30] Foreign Application Priority Data

Jul. 8, 1987 [AT] Austria ..... 1724/87

[51] Int. Cl.[5] ..... E04B 1/32

[52] U.S. Cl. ..... 52/81; 52/86; 52/727

[58] Field of Search ..... 52/81, 86, 227

[56] References Cited

U.S. PATENT DOCUMENTS

| | | | |
|---|---|---|---|
| 3,601,944 | 8/1971 | Shepherd | 52/641 |
| 3,676,964 | 7/1972 | Anglade | 52/86 |
| 3,690,078 | 9/1972 | Maynard | 52/86 |
| 3,708,944 | 1/1973 | Miyake | 52/86 |
| 3,798,851 | 5/1974 | Utahara | 52/86 |
| 3,889,433 | 6/1975 | Eubank, Jr. | 52/86 |
| 3,994,106 | 11/1976 | Grasser | 52/81 |
| 4,325,207 | 4/1982 | Russell et al. | 52/641 |
| 4,619,099 | 10/1986 | Sircovich | 52/86 |

FOREIGN PATENT DOCUMENTS

| | | | |
|---|---|---|---|
| 7415870 | 7/1925 | Fed. Rep. of Germany | 52/86 |
| 2800720 | 7/1978 | Fed. Rep. of Germany . | |
| 3311397 | 10/1984 | Fed. Rep. of Germany . | |
| 2194851 | 1/1972 | France . | |

*Primary Examiner*—Henry E. Raduazo

*Attorney, Agent, or Firm*—Beveridge, DeGrandi & Weilacher

[57] ABSTRACT

A supporting frame structure including supporting bars is disclosed. The structure is polygonally-curved in at least one direction to increase its dimensional stability despite a low bending resistance of the bars of the supporting structure and the bar bend points or nodes. Two bar bend points are connected together by a prestressed tension member of a first set of prestressed tension members while two bend points, which lie on opposite sides of one of the two bend points connected by the tension member of the first set, are connected by a tension member of a second set of prestressed tension members. To dampen vibrations induced in the supporting frame structure, spring-damper elements are provided. Such spring-damper elements also can be used to prestress the tension members of the two sets thereof.

5 Claims, 2 Drawing Sheets

FIG. 1
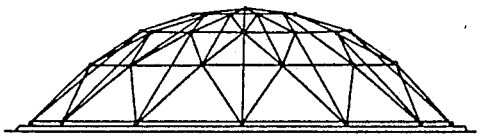
FIG. 2
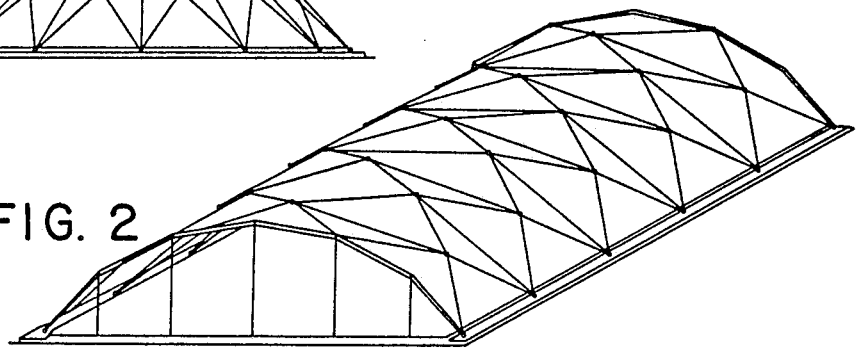
FIG. 4
FIG. 3
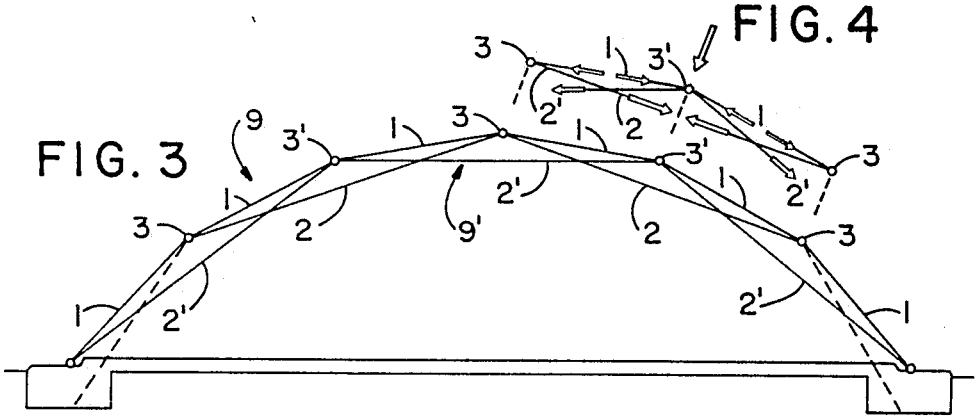
FIG. 5
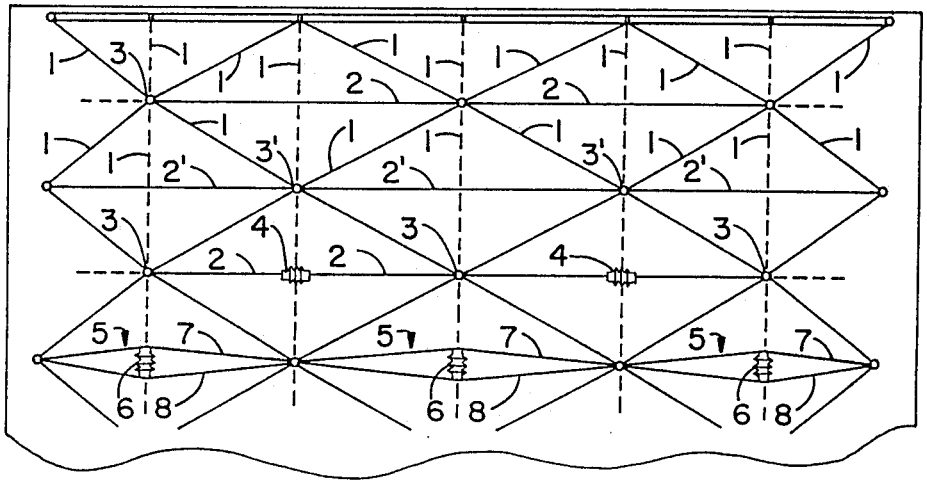

FIG. 6
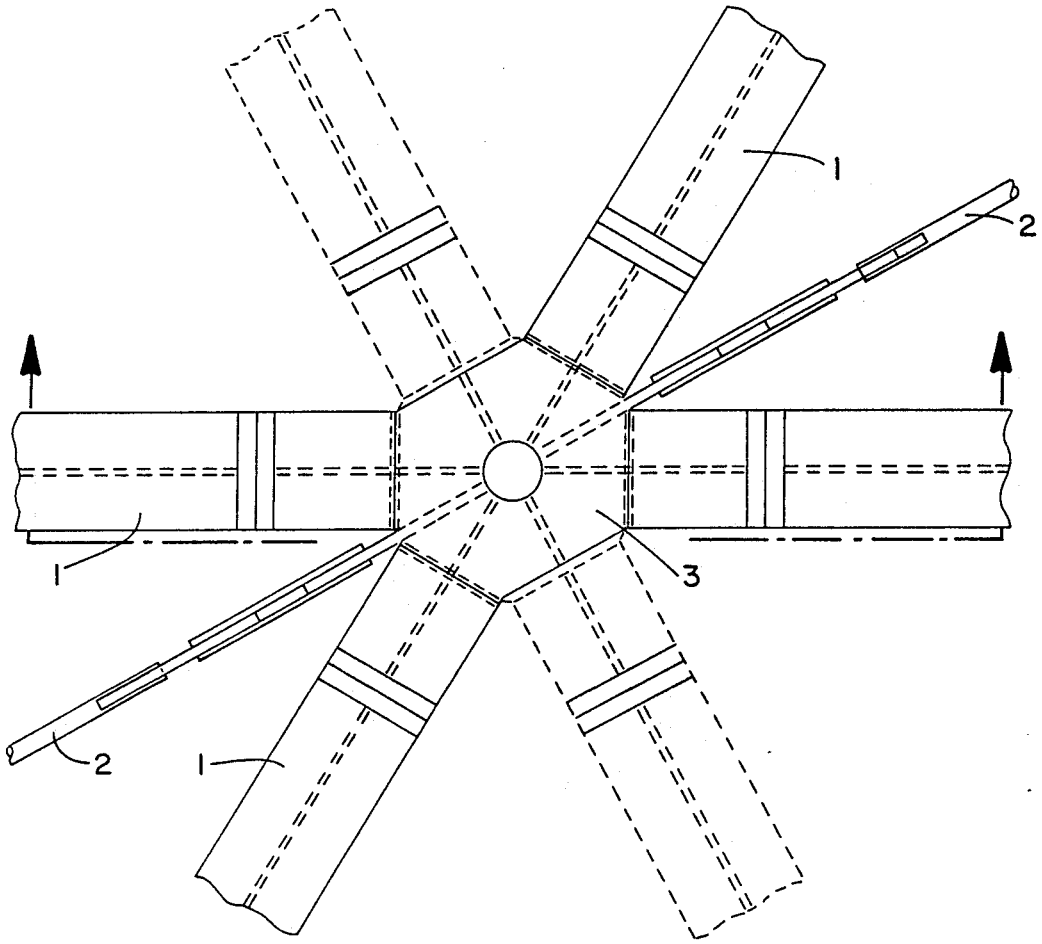
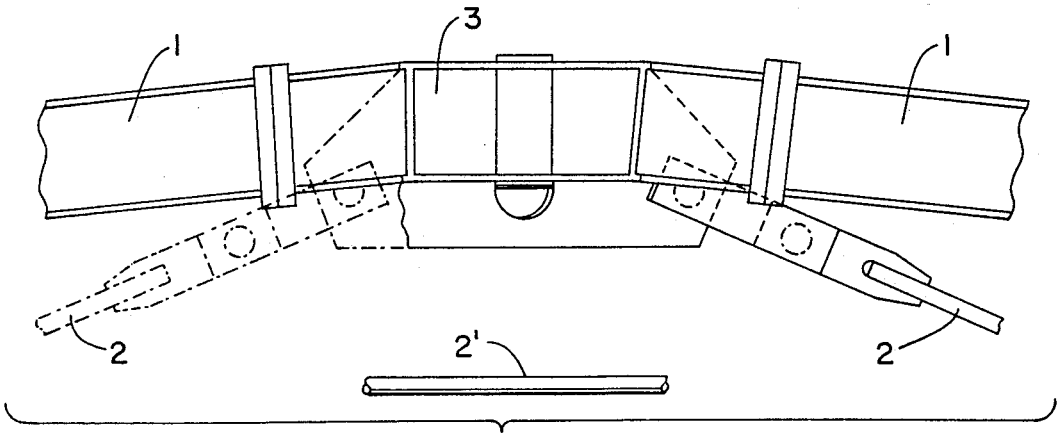
FIG. 7

SINGLE-LAYER, POLYGONALLY-CURVED SUPPORTING FRAME STRUCTURE

BACKGROUND OF THE INVENTION

The invention relates to a single-layer, polygonally-curved supporting frame structure in which pairs of bend points of the supporting structure bars are connected to one another by the tension members of a first set thereof and in which bend points intermediate those connected by the tension members of the first set are connected to one another by the tension members of a second set thereof to omit the bend points connected by the tension members of the first set. Single-layer polygonally-curved supporting frame structures can be used for barrel-shaped, dome-shaped or other double curved roof supporting structures.

Barrel-shaped and dome-shaped supporting structures have provided very economical types of covers. Under uniform loading and with ideal shaping, only compressive forces occur in such supporting structure systems. However, great deformation, and collapse, can occur as a result of additional loading one side, such as by large individual loads or horizontal loads due to wind, etc. Hitherto, this was prevented by the use of arched beams having high resistances to bending, arched frameworks or double-layer, curved frame structures which, in addition to forces normal to the direction of arch also were able to absorb large bending moments. This approach, however, resulted in heavier and thus less economical construction.

German Offenlegungsschrifts No. 2,800,720 and German Offenlegungsschrift No. 3,311,397 disclose single-layer, frame supporting structures of the above-mentioned type.

The roof construction disclosed by German Offenlegungsschrift No. 3,311,397 for covering halls, swimming pools, sewage plants and the like shows profiles bridging the span which are angled in the same direction at a plurality of points and run rectilinearly between the bend points. The profiles are arranged next to each other so that the bend points of each profile are located next to the center area between the bend points of each adjacent profile. Adjacent profiles are connected to one another by diagonal struts in the form of two legs abutting at an obtuse angle. The apex areas and leg ends of the diagonal struts are connected to the profiles at the bend points of the profiles. With regard to the joined diagonal bars, the "bend points" (namely, the apices and the leg ends) are in each case connected to one another by bars while omitting one bend point each in between.

German Offenlegungsschrift No. 2,800,720 relates to a framework construction in a modular design system for arched covers which are composed of a plurality of triangular supporting structures having a curved profile whose reticular shell consists of a rigid triangular and/or rhombic mesh. The sloping, bar-shaped elements defining the mesh can be drawn in geodetic lines running helically and crossing one another. German Offenlegungsschrift No. 2,800,720 discloses reinforcing tension bars which connect diagonally opposite corner points of a rhombic mesh, the adjacent corner points being "omitted."

SUMMARY OF THE INVENTION

The object of the invention is to provide a single-layer, polygonally-curved supporting frame structure for barrel-shaped, dome-shaped or other double-curved covers which, despite nonuniform loading, additional individual loads, or horizontal loads from the wind, or the like, produces only compressive forces in its supporting bars and, despite a low bending resistance of the bars and joints (bend points), ensures high dimensional stability of the entire supporting structure.

This object is achieved in a single-layer, polygonally-curved supporting frame structure wherein the tension members which connect two joints or bend points on opposite sides of another intermediate bend point are prestressed.

The supporting frame structure according to the invention, due to the prestressed tension members between each two bar bend points on either side of another bar bend point, is a rigid supporting structure since a plurality of prestressed struts result. The struts do not permit a single bend point to change its predetermined position on the theoretical circle of curvature. This is achieved by prestressing forces which are applied to the tension bars after assembly of the frame structure. The prestressing forces are selected to be sufficiently large that, from the outset, they constantly produce in the individual supporting structure bars, a portion of, or all of the stresses (internal forces) which are caused by the external forces acting on the bend points. These prestressing forces are proportionally removed only by actually occurring external forces so that lesser changes in shape result during actual loading of the supporting structure.

To achieve short bend lengths, in the transverse direction, of the supporting structure bars under compression, the bars also can be arranged in a rhombus shape. In this arrangement, junctions of four to six bars form the bend points of the supporting structure. Although these bar arrangements, rhombic in the case of four bars per bend point (node) and triangular in the case of six bars per bend point (node), are known, no excessive loads could be superimposed at the node points (bend points) in the case of single-shell framed structures. Otherwise, the bend point would collapse in the direction of force according to a toggle-lever effect due to the acting forces.

The prestressed tension members provided according to the invention, by their arrangement between adjacent nodes (bend points), subtend every node which is at risk of collapse. The tension members acting on the nodes prevent the nodes from deviating in the direction of bending force. Thus the above-mentioned plurality of prestressed strut frames are formed, which strut frames do not permit a single node to leave its position on the allocated circle of curvature. The tension members connecting the nodes are prestressed to such an extent that a portion of, or all of the stresses (internal forces) which are caused by the external forces (superimposed loads) acting on the bend points constantly act on the supporting bars and these prestressing forces are proportionally removed only by actually occurring external forces so that smaller changes in shape will result during actual loading of the supporting structure. This can be explained by the fact that an external force acting on a node relieves the tension members acting on the same node. As a result, the external force in the bars absorbs a portion of the prestressing forces. Compared with a system of the same type which is not prestressed, the change in shape is accordingly smaller.

In an arrangement according to the present invention, the tension members are split up or otherwise provided in a rhombus shape by transverse compression elements connected between the split up elements for maintaining the split up arrangement. Small, measurable, compressive forces by these compression elements (e.g., disk spring stacks) can apply a prestressing force of any magnitude in a simplest manner since a high force ratio is provided in this arrangement.

Since light supporting structures are susceptible to vibrations over large spans, spring-damper elements also can be provided in the tension members. By integrating such spring-damper elements in the split-up tension members (transverse spring-damper elements), weaker and therefore less expensive spring-damper elements can be used which, due to the high force ratio, also dampen the smallest deformations (amplitudes of vibration) which change the locations of the nodes and the positions of the nodes relative to one another.

BRIEF DESCRIPTION OF THE DRAWINGS

The invention is described in greater detail with reference to the following schematic drawings and exemplary embodiments. In the drawings:

FIG. 1 is an elevational view of a dome-shaped supporting structure constructed according to the present invention;

FIG. 2 is a perspective view of a barrel-shaped supporting structure constructed according to the present invention;

FIG. 3 is a cross-sectional view of the supporting structure of FIGS. 1 and 2;

FIG. 4 is useful for understanding the force relationships in the supporting structure according to the present invention;

FIG. 5 is a plan view of the barrel-shaped supporting structure of FIG. 2 (and FIG. 3);

FIG. 6 shows one of several possible node arrangements of the supporting structure according to the present invention; and FIG. 7 is a view along line VII—VII of FIG. 6.

DETAILED DESCRIPTION OF THE PREFERRED EMBODIMENTS

In the Figures, the supporting frame structures according to the present invention have been shown with only a few members for clarity, although, in fact, such supporting structures usually have substantially more members.

FIG. 1 schematically shows a prestressed, single-layer, polygonally-curved, dome-like frame structure, and FIG. 2 schematically shows a single-layer, polygonally-curved barrel-like frame structure.

In FIG. 3, there is shown a schematic section through a prestressed, polygonally-curved supporting structure. Here, the supporting structure bars 1, under compression, are shown in thick lines and the prestressed tension members 2 are shown in thinner lines. The joints or bend points 3 for the bars 1 are also the connection points of the prestressed tension members 2. It is apparent from FIG. 1 that every prestressed tension member 2 of a first set of tension members connects two bar bend points 3 on the opposite sides of an "omitted" bar bend point 3' intermediate therebetween Accordingly, the prestressed tension members 2' of a second set of tension members connect bar bend points 3' on either sides of bar bend points 3 located intermediately thereof.

In FIG. 4, a part of the frame structure is shown in detail. This is useful in understanding the effect of prestressing of the supporting structure bars 1 by the tension members 2 and the effect of an external force F at the bend point 3. It can also be recognized that, when an external force acts, the tension member 2 is loaded additionally, whereas the tension members 2' acting at the load application point and the bar bend points 3' are relieved of load.

FIG. 5 is a plan view of a supporting frame structure linked in a rhombus shape. The supporting structure bars 1 shown by dotted lines in the longitudinal axis also can be omitted in single-curve supporting structures. In double-curve supporting structures, such as, e.g., frame, dome structures, they form a tension ring which shapes the entire structure.

FIG. 5 also shows the arrangement of spring-damper elements 4 in the tension members 2. Further, an arrangement wherein the tension members 5 have spaced-apart or split-up portions 7 and 8 forming a rhombus shape is shown in FIG. 5. The compression elements necessary for prestressing and spacing apart the portions 7 and 8 of the tension members 5 likewise can be provided as spring-damper elements 6.

FIGS. 6 and 7 show a possible embodiment for the bar bend points 3 and at the same time the node design for four to six supporting structure bars 1 having the prestressed tension members 2 acting on the node 3 are provided.

The single-layer, polygonally-curved supporting frame structure according to the invention prevents large bending moments from being induced in the frame structure system in the event of non-uniform loading, additional individual loading or horizontal forces produced by wind, etc., which bending moments otherwise could lead to large deformations of the entire system or collapse of the bar nodes (bend points in the frame structure) by loads acting thereon by a "toggle-lever effect". This is achieved in the supporting structure according to the invention consisting of bars 1 connected by two bar bend points or nodes 3, wherein each of the bend points or nodes 3 is connected by prestressed tension members 2 that "omit" a bar bend point 3' in between. The bar bend points 3' intermediate therebetween in turn likewise are connected to one another by prestressed tension members 2' on opposite sides of the above-mentioned connected bend points 3. Thus a plurality of prestressed strut frames 9 including bars 1, tension members 2 and bend point 3' and strut frames 9' including bars 1, tension members 2' and bend points 3' are provided which strut frames do not permit a single bar bend point or node 3, 3', to alter its position on the allocated circle of curvature. By prestressing the tension members 2, 2', the rigidity of the supporting frame structure according to the invention is increased. The tension members can also be provided in two portions ("split-up") in rhombus shape. Prestressing of the split-up tension members 5 can be done inexpensively and accurately according to a high force ratio by small, transverse compression elements which maintain the split-up arrangement. To dampen vibrations caused by wind agitation for example in these light-weight supporting structures which usually span a considerable distance, spring-damper elements 4 and 6 can be provided to connect between the tension members 2 and 5, respectively. The tension members 2, 5 usually are made of round-shape steel, square-shape or flat steel. The bars 1 must be capable of absorbing compression forces and are therefore usually made of round or square shape tubes, or light-flanged steel beams. Instead of steel, for certain purposes, aluminum could be used in both the tension members 2 and the bars 1.

Commercially available dampers having spring resetting means, as are known per se from heavy vehicle construction, crane construction, etc., can be used as the spring-damper elements. The spring-damper elements, designed as hydraulic dampers or as friction dampers, suppress vibrations. The springs determine the lengths and the extent of prestressing of the individual tension members, which can vary during vibration of the roof and then return to the length at the position of equilibrium.

What is claimed is:

1. A single-layer, polygonally-curved supporting frame structure having increased rigidity by means of prestressed tension members, said structure including a plurality of supporting bars which are connected to each other at bend points, a first set of tension members which members connect pairs of a first plurality of said bend points, and a second set of tension members which members each connect two bend points of a second plurality of said bend points, each two bend points of said second plurality thereof lying on opposite sides of each said bend point which is connected by a tension member of said first set, all of the tension members of said first and second sets being prestressed under tension whereby all of said supporting bars are under compression and the rigidity of the resulting frame structure is improved.

2. A single-layer, polygonally-curved supporting frame structure having increased rigidity by means of prestressed tension members, said structure including a plurality of supporting bars which are connected to each other at a plurality of bend points, a first set of tension members which members connect pairs of said bend points, a second set of tension members which members each connect two bend points lying on opposite sides of each said bend point which is connected by a tension member of said first set, and compression elements, the tension members comprising two-portion tension members having a first portion spaced apart from a second portion thereof by a compression element, the spaced-apart portions defining a rhombus shape, one of said compression elements spacing apart said portions to prestress each two-portion tension member, the tension members of said first and second sets of tension members thereby being prestressed to improve the rigidity of the resulting frame structure.

3. The supporting frame structure as claimed in claim 2, wherein the compression elements comprise spring-damper elements.

4. The supporting frame structure as claimed in claim 1, wherein said tension members are provided with spring-damper elements which act in the direction of the longitudinal length of said tension elements, said spring-damper elements simultaneously prestressing said tension members.

5. A single-layer, polygonally-curved supporting frame structure having increased rigidity by means of prestressed tension members, said structure including a plurality of supporting bars, a plurality of tension members provided as a first set of tension members and a second set of tension members, and a plurality of connective elements provided as a first set of connective elements and a second set of connective elements, each connective element of said second set lying on opposite sides of each said connective element of said first set, each of said supporting bars connecting one pair of said connective elements, each of said tension members of said first set connecting a pair of connective elements belonging to said first set of connective elements, each of said tension members of said second set connecting one pair of connective elements belonging to said second set of connective elements, all of said tension members being prestressed under tension to place all of said supporting bars under compression.

* * * * *